US007422662B2

(12) United States Patent
Leimu et al.

(10) Patent No.: US 7,422,662 B2
(45) Date of Patent: Sep. 9, 2008

(54) SEALING ARRANGEMENT AGAINST A MOVING FABRIC

(75) Inventors: Juha Leimu, Turku (FI); Antti Komulainen, Keuruu (FI); Kari Juppi, Palokka (FI); Matti Kurki, Jyväskylä (FI); Martti Salminen, Lievestuore (FI); Reijo Jokinen, Raisio (FI)

(73) Assignee: Metso Paper, Inc., Helsinki (FI)

( * ) Notice: Subject to any disclaimer, the term of this patent is extended or adjusted under 35 U.S.C. 154(b) by 196 days.

(21) Appl. No.: 10/532,962

(22) PCT Filed: Nov. 19, 2003

(86) PCT No.: PCT/FI03/00891

§ 371 (c)(1),
(2), (4) Date: May 12, 2005

(87) PCT Pub. No.: WO2004/046460

PCT Pub. Date: Jun. 3, 2004

(65) Prior Publication Data

US 2006/0070258 A1 Apr. 6, 2006

(30) Foreign Application Priority Data

Nov. 19, 2002 (FI) ..... 20022063

(51) Int. Cl.
*D21F 1/52* (2006.01)
*D21F 5/00* (2006.01)

(52) U.S. Cl. ..... 162/374; 162/364; 162/367; 277/412

(58) Field of Classification Search ..... 162/363, 162/364, 367, 370, 371, 374; 277/303, 412, 277/300; 34/109, 111, 116, 117, 120
See application file for complete search history.

(56) References Cited

U.S. PATENT DOCUMENTS

| | | | | | |
|---|---|---|---|---|---|
| 3,072,181 | A | * | 1/1963 | Goodwillie | 162/350 |
| 4,359,827 | A | * | 11/1982 | Thomas | 34/452 |
| 4,359,828 | A | * | 11/1982 | Thomas | 34/114 |
| 5,341,579 | A | | 8/1994 | Schiel et al. | |
| 5,477,624 | A | * | 12/1995 | Haessner et al. | 34/117 |
| 5,509,215 | A | | 4/1996 | Koiranen et al. | |
| 5,782,009 | A | * | 7/1998 | Kotitschke | 34/117 |
| 6,189,232 | B1 | * | 2/2001 | Milosavljevic et al. | 34/117 |
| 6,192,597 | B1 | * | 2/2001 | Kahl et al. | 34/115 |
| 6,247,247 | B1 | | 6/2001 | Yömaa et al. | |

(Continued)

FOREIGN PATENT DOCUMENTS

DE 4314475 A1 12/1993

(Continued)

*Primary Examiner*—Eric Hug
(74) *Attorney, Agent, or Firm*—Cohen Pontani Lieberman & Pavane LLP

(57) ABSTRACT

The invention relates to a sealing arrangement (7) against a moving fabric (4*b*) in a paper machine or the like. The sealing arrangement includes a stiff sealing element (9) placed on the fabric's (4*b*) side on the entire width in connection with a paper sheet (4*a*) supported by the fabric (4*b*). The sealing element has been arranged on a support so that the location of the sealing element with respect to the fabric (4*b*) can be adjusted nearer to or, correspondingly, further from the fabric. As a sealing element there is at least a single-chambered labyrinth sealing (19).

11 Claims, 4 Drawing Sheets

U.S. PATENT DOCUMENTS

Figure 1:
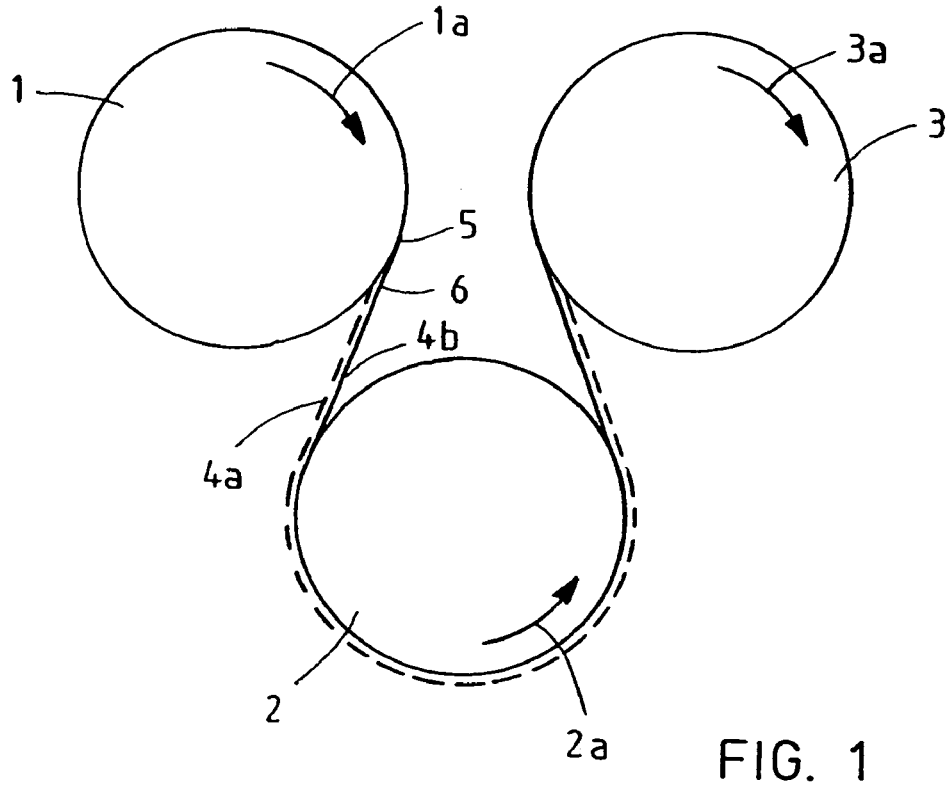

| | | | | |
|---|---|---|---|---|
| 6,317,999 | B1 | 11/2001 | Virta et al. | |
| 6,592,721 | B1 * | 7/2003 | Anderson et al. | 162/274 |
| 6,740,204 | B2 * | 5/2004 | Kahl et al. | 162/363 |
| 6,848,195 | B2 | 2/2005 | Leimu | |
| 6,910,282 | B1 | 6/2005 | Jokinen et al. | |
| 2003/0034139 | A1 | 2/2003 | Kahl et al. | |

FOREIGN PATENT DOCUMENTS

| | | | |
|---|---|---|---|
| EP | 0566552 | A1 | 4/1992 |
| FI | 925656 | | 6/1993 |
| FI | 102400 | B | 10/1998 |
| FI | 102774 | B | 10/1998 |
| FI | U990444 | | 2/2000 |
| FI | 111280 | | 5/2003 |
| JP | 2002538318 | | 11/2002 |
| WO | WO 98/48109 | A1 | 10/1998 |
| WO | WO 00/50693 | * | 8/2000 |

* cited by examiner

SEALING ARRANGEMENT AGAINST A MOVING FABRIC

This is a national stage of PCT application No. PCT/FI03/000891, filed on Nov. 19, 2003. Priority is claimed on application No. 20022063, filed in Finland on Nov. 19, 2002.

TECHNICAL FIELD OF THE INVENTION

The object of the invention is a sealing arrangement against a moving fabric in a paper machine or the like according to the preamble of the independent claim presented below. The invention particularly relates to a sealing arrangement including a stiff sealing element placed on the side of the fabric, on the entire width, in connection with a paper sheet supported by the fabric.

PRIOR ART

It is known to guide the paper web in different ways in order to keep the paper sheet to be dried in connection with the wire even at high speeds of the paper web and at changing speeds. For example, blow apparatuses and arrangements based on the use of underpressure are used. It has been noticed that when the speed of the paper web exceeds 1500 m/min, the conventional arrangements are no more sufficient in order to maintain the functioning stable and undisturbed. It is essential that the paper machine functions in a reliable way, i.e. the so-called runnability should be good. The time spent on working out web breaks becomes expensive because at the same time a considerable amount of production is lost. This also affects the reliability of delivery, and thus important economical values of the factory. In order to control air flows and pressure differences it is known to use different kinds of sealings in connection with the paper web, the wire and the cylinders of a paper machine. The distance of the sealing from the wire or the paper web must be accurately guidable: from too big a gap the air may escape in an uncontrolled way, and if the gap is too small, the sealing may touch the paper web causing damage thereto. The US publication U.S. Pat. No. 6,192,597 presents a structure in which a sealing plate mounted across the web is used as a sealing element, the location of which sealing plate can be adjusted with a power cylinder and supported by a swivel nearer to or further from the wire. Because this kind of an arrangement has no self-adjusting properties, the gap needs to be searched by adjusting to a suitable size, which is rather difficult and requires re-adjusting if the circumstances change. The US publication U.S. Pat. No. 5,782,009 presents a suction box extending near the paper web, in which suction box air is sucked from the area close to the opening nip in order to control the paper web. The front edge of the suction box part is, however, near the paper web and is formed only of a simple plate-like sealing part. The patent application FI 20012160 presents a suction box structure in which the so-called Coanda-effect is utilized with the aid of curved sealing elements placed on trigger hinges. The structure is rather large in size filling the interspace between the rolls to a great extent. It is also to be taken into account that in a mechanical contact the sealing itself wears out even very quickly due to the effect of the wire. In that case, the sealing needs to be changed every now and then. A worn sealing may even break off, thus causing a severe disruption to production as the wire gets damaged. Production of overpressure air and underpressure air for the use of air guidance systems in the drying section of a paper machine consumes a lot of energy. In order to produce underpressure in a large scale, the electric motors of the blowers, compressors and underpressure pumps need to have great output capacities and the flow channels belonging to the apparatus need to be big in size. Also the noise problems are considerable. Accordingly, the sound attenuators used for noise prevention are big and expensive and occupy a lot of factory space.

OBJECT AND DESCRIPTION OF THE INVENTION

The main object of the present invention is to reduce or even to eliminate the problems arising in the above-mentioned prior art.

The object of the present invention is especially to improve the runnability and the operating efficiency of a paper machine and thus, at the same time, the reliability of a paper machine especially when the production speed is high, i.e. when the speed exceeds 1500 m/min, even 2000 m/min. The object of the invention is also to reduce energy consumption and noise problems. An object is also to reduce the size of the sound attenuators needed for noise prevention.

In order to carry out the above-mentioned objects, among others, the sealing arrangement against a moving fabric in a paper machine or the like according to the invention is characterized by what is presented in the characterizing part of the enclosed independent claim.

A sheet in this text means a paper, board or other corresponding sheet that is manufactured in the paper machine. A fabric means a mesh, a wire or the like, movable in the paper machine in order to support the said sheet. A labyrinth sealing means all sorts of labyrinth sealings suitable for the purpose.

The sheet coming from the opening gap between the cylinder and the fabric, such as the wire, supporting the paper web or the like, tends to follow the more adhesive plain surface of the cylinder with the help of an underpressure pulse affecting the sheet in the opening wedge space. These forces are counteracted by means of an underpressure through the fabric against the sheet in order to make the sheet follow the fabric ahead in the drying section. An object of the invention is to boost and to improve the control of said suctions by reducing the underpressure loss of the underpressure space.

A typical sealing arrangement against a moving fabric according to the invention in a paper machine or the like comprises a stiff sealing element placed at least mainly on the entire width of the paper sheet, on the fabric's side, in connection with a paper sheet supported by the fabric. If the sealing element has been arranged on a support so that the location of the sealing element with respect to the fabric is adjustable nearer to or, correspondingly, further from the fabric, then the functioning of the sealing can be controlled so that the interspace between the sealing and the surface to be sealed can be defined, and thus have an effect on the tightness of the sealing arrangement. This fact has a considerable influence on the amounts of air needed, and thus on the energy consumption. If at least a single-chambered labyrinth sealing is used as a sealing element, this choice provides a tighter sealing than a conventional sealing arrangement, which has a sealing point at one place only. Thereby, by the choice of the place of the labyrinth sealing not only an efficient sealing but also energy savings are attained.

A labyrinth sealing is particularly advantageous in a sealing arrangement according to the invention in which the sealing element is movable to different distances from the fabric. If the sealing element is worn out, for example when getting into contact with the moving fabric due to its own movement, its sealing effect remains considerably good, thanks to the several sealing points of the labyrinth sealing when compared to a sealing element having only one sealing point. The structure of a labyrinth sealing presents an advantage also when a foreign object, such as a piece of paper, typically damaging the sealing, passes through between the sealing and the fabric. It is then likely that at least some of the several successive sealing areas of the labyrinth sealing remain intact to some extent. To arrange several sealing points to move simultaneously as in a labyrinth sealing would require a complicated structure if several separate single sealing elements were used.

One embodiment of the invention comprises means with which the air flows can be guided so that with the aid of the created air flows the pressure on the fabric side of the sealing element is different than on the other side of the sealing element. In this way, the sealing element can be moved, with respect to the fabric, nearer to or further therefrom by guiding said air flows and pressure difference.

Then no special mechanical moving members are needed, but remote control can be easily performed by using control engineering known per se.

One embodiment of the invention comprises, in connection with the sealing element, bellows or a corresponding moving element operated with a medium, as well as means for leading the medium into the bellows or the like in a controlled manner. In this way it is possible to control the pressure arranged in the bellows or the like, and thereby the movement of the bellows or the like, and thereby the distance from the fabric of the sealing element connected to said bellows. In this way a relatively simple adjustment of the movement of the sealing element is attained. In the bellows, pressurized air is typically used as a pressure medium, even though also other pressure media are possible.

If the nearest surface of the sealing element is, without air flows caused, at least mainly in a slight contact with the fabric, the sealing effect is good and, yet, wearing of the sealing is rather small.

According to one embodiment of the invention, the sealing element that is placed at least mainly on the entire width of the paper web, is formed of at least two, preferably of several successively arranged sealing element units. Thereby, the arrangement also comprises means for detachably fixing the individual sealing element units to the arrangement according to the invention, for example to some paper machine frame part located in cross direction. Such sealing element units can be separately manufactured and mounted. Thus, the mounting and servicing measures are much more simple and easy than when handling a sealing element having the width of the web.

If the sealing element includes a frame structure, which supports a form of sealing that is replaceable in the running position near the surface of the fabric, the replacing operation can be performed quickly and easily. It is advantageous to replace only the easily replaceable sealing element that is worn out.

If the sealing is at least a single labyrinth sealing, preferably a multi labyrinth sealing, an efficient sealing effect and thereby low energy consumption are achieved.

According to one embodiment of the invention, a pressure medium is used for guiding the location of the sealing element. Thereby, electronic and mechanical structures can be avoided, as such structures often have been known to include operational insecurity and malfunctions.

According to one embodiment of the invention, the frame structure of the sealing element includes openings for adjusting the air flow. Such structure is simple and secure in operation. Such adjustment openings can be arranged as combinations, for example in pairs so that the openings of a pair of openings are in different bodies, which bodies are arranged to be movable in relation to each other. This movement can be guided for example with a medium arrangement according to the invention so that the openings can face each other entirely or partly, or do not face each other at all. For example, when the openings face each other, an air flow can pass through the openings. When such openings are moved in relation to each other, the air flow through the openings is at least mainly prevented. In such solutions moving parts may not be necessary at all.

The frame of one sealing element according to the invention is supported by a hinge-like support element, whereby the structure is easy to manufacture and has no separate moving parts.

According to one embodiment of the invention, the hinge-like support is located higher than the sealing element. Then the structure can be arranged so that the gravity of the earth affects the structure with a force pulling away from the fabric and with the aid of air flows the structure is deviated from its initial position closer to the fabric. The solution is also safe, as in this case the ending of the deviation takes the sealing element further away from the fabric, whereby there is no danger of damage. A sealing articulated from below can also be considered, but in that case it is usually necessary to secure the loss of load by a mechanical restitution and it is also usually more challenging to carry out the adjustment of the sealing element's movement.

A labyrinth sealing arranged in connection with the underpressurized space and adjustable by its distance to the fabric is an advantageous solution, because the manufacture of the sealing element in question can be carried out with a bigger tolerance and thus with lower costs. Such an application can however be considered, especially in fairly narrow paper machines, that the sealing has been carried out otherwise correspondingly, but there is whether no adjustment or only a slight mechanical adjustment margin.

It is recommended that the said labyrinth sealing is made of aluminum or alternatively, at least regarding the part that is near the fabric, of board, paperboard, polymer or the like. Then the manufacture of the sealing is quite easy and there are several alternative manufacturing methods for the sealing element made of aluminium, as well as, for the rest of the mentioned solutions.

SHORT DESCRIPTION OF THE FIGURES

Figure 2:
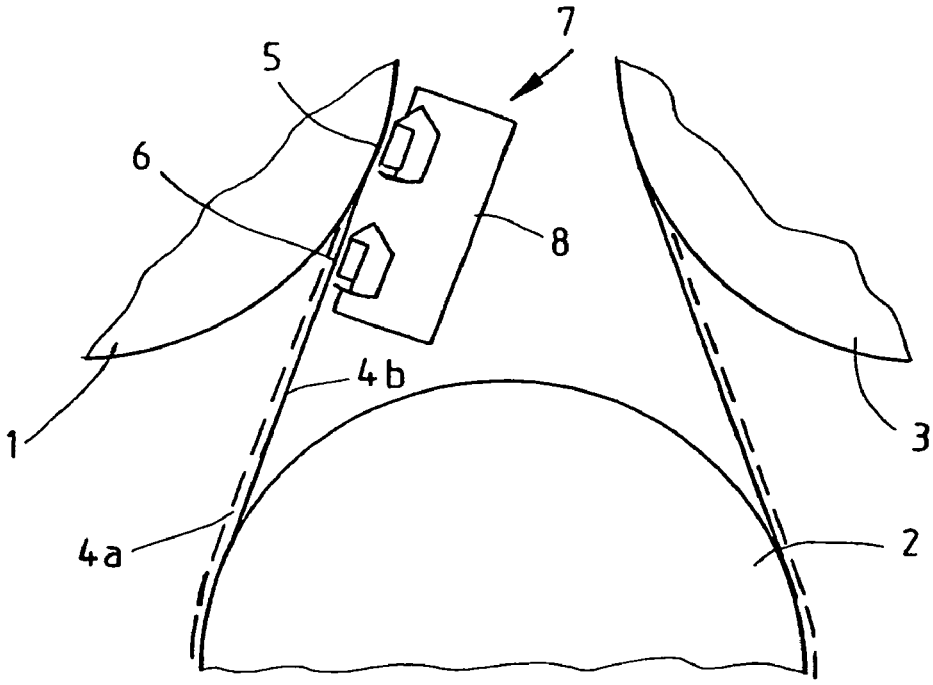
Figure 3:
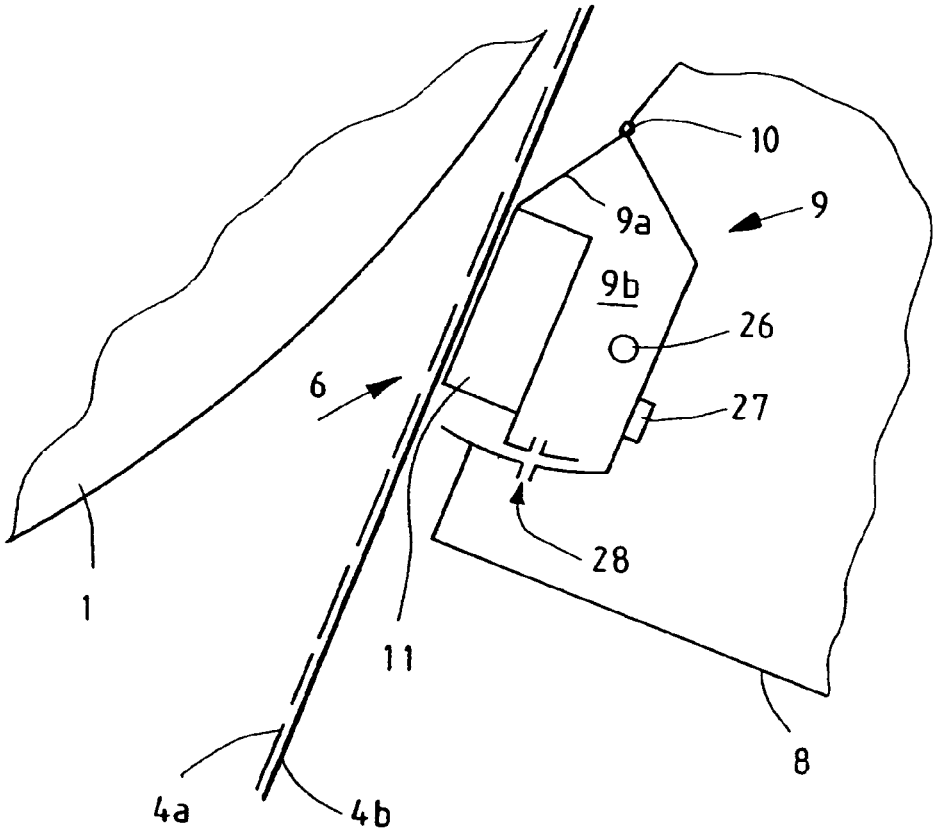
Figure 4:
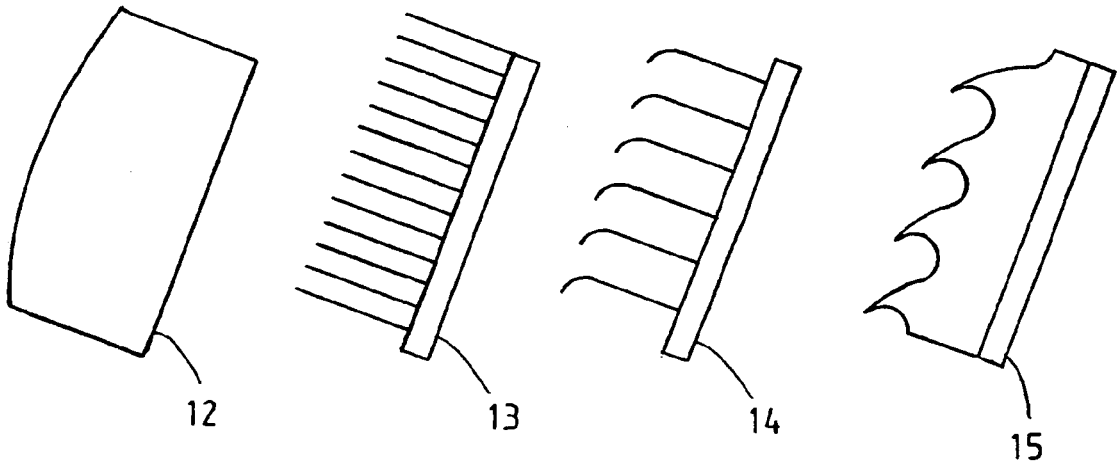
Figure 5:
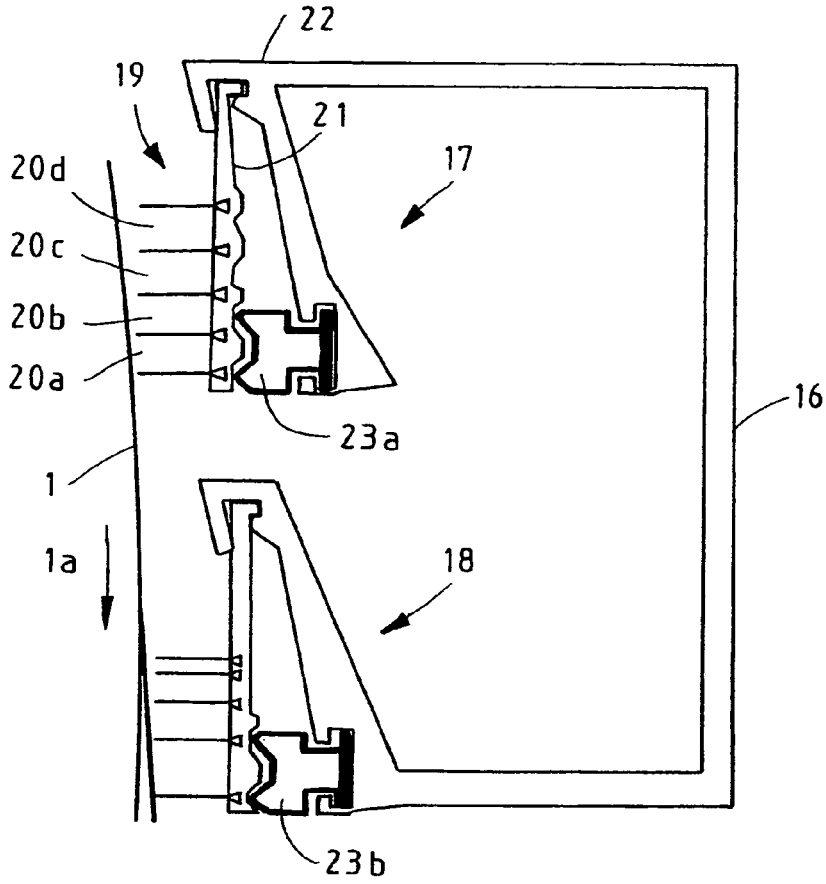
Figure 6:
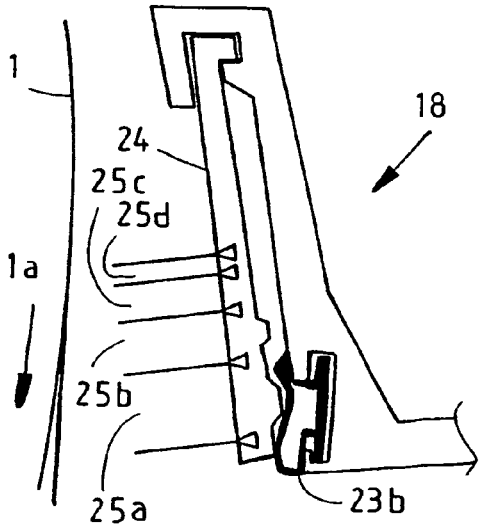
Figure 7:
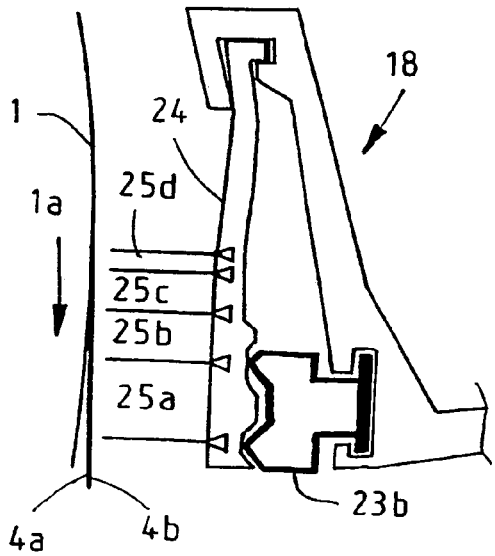
Figure 8:
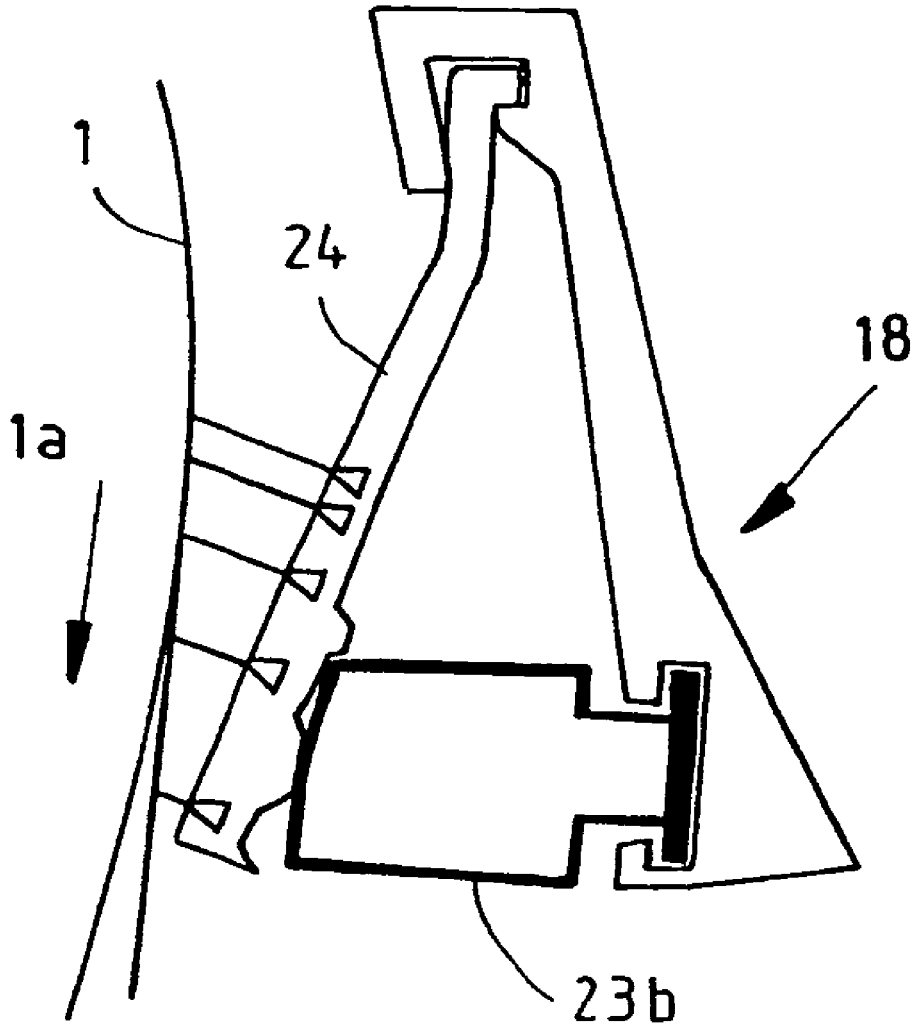

In the following, the invention is described more closely with reference to the enclosed schematic drawing, in which FIG. 1 schematically illustrates an application of the use of the invention, a part of the drying section of a paper machine, the pocket space defined by drying cylinders, a turning suction cylinder and a wire, FIG. 2 schematically illustrates the drying section according to FIG. 1 enlarged and when using a sealing arrangement according to the invention, FIG. 3 schematically illustrates the sealing arrangement enlarged and partly illustrated in FIG. 2, FIG. 4 schematically illustrates some possible sealing profiles used in the sealing space, FIG. 5 schematically illustrates near the roll one hinged sealing arrangement according to the invention, FIG. 6 schematically illustrates the lower part of the sealing arrangement according to FIG. 5 when the sealing is far from the paper web and especially in a replacement position, FIG. 7 schematically illustrates a sealing arrangement according to FIG. 6 in a normal operating position, and FIG. 8 schematically illustrates a sealing arrangement according to FIG. 6 when the sealing element is almost worn out and before replacement.

DETAILED DESCRIPTION OF THE EMBODIMENTS OF THE FIGURES

In FIG. 1 of the drawing, the reference number 1 refers to a cylinder in the drying section of a paper machine and the rotation direction of the cylinder 1 is referred to with the reference mark 1*a*. A web 4, that includes here a paper sheet 4*a* marked with a broken line and a fabric 4*b* marked with an unbroken line, travels after the cylinder 1 to a turning suction roll 2 and further to a cylinder 3. The rotation directions are marked with arrows 2*a* and 3*a*. The point of the cylinder 1 where the web 4 detaches from the periphery of the cylinder downwards to the direction of the turning suction roll 2, is marked with the reference number 5 and the reference number 6 is marked at a distance from there forward along the web 4.

FIG. 2 illustrates a part of the drying section according to FIG. 1 as an enlargement from the area between the cylinders 1, 2 and 3, and from the pocket space formed by the fabric 4*b*. Near the points 5 and 6 there has been placed a sealing arrangement 7 that is formed of a box-like underpressure space 8, which has, in the cross direction of the machine, the width of the web 4 or even more if necessary. It is usually necessary that the sealing arrangement 7 is located from its upper part at least in some degree higher than the point of the reference number 5, so that the function would be efficient.

FIG. 3 illustrates as an enlargement a sealing element 9*a* used at the point 6, which sealing element has been placed in suspension from its upper part to a supporting point 10, which allows the sealing element to decline. It is recommended to use in the supporting point 10 a so-called trigger hinge known per se. The sealing element 9*a* has a space 11 for a labyrinth sealing or the like, which space 11 is on that side of the sealing element 9*a* that is on the fabric's 4*b* side of the web 4. When pressurized air is led to the box-like part 9*b*, this has an effect on the sealing element 9*a* so that the sealing element 9*a* moves closer to the fabric 4*b*. The leading of underpressurized or overpressurized air can take place into the box-like part 9*b* at an overpressure via a pipe 26 or, alternatively, at an underpressure via openings 27 or via a combination of openings 28 from the underpressure space 8. If the openings of the combination of openings 28 face each other, an air flow can pass through this way quite freely, and when the openings of the combination of openings 28 do not face each other, the flow is a minor leakage flow. The openings 27 can be adjustable, made for example of a sliding damper structure (not shown). If the pressure of the pressurized air is further increased, at a certain point the labyrinth sealing in the space 11 touches the fabric 4*b*, which is disadvantageous because then the sealing is quickly worn out. In the supporting point 10 the pivoting has been arranged so as to be rather mobile and therefore it has been carried out with the help of a so-called knife bearing, trigger hinge or the like, known per se. If, for example, a piece of paper or some other material foreign to a normal web comes along the web 4, the sealing element 9*a* that is very mobile can turn aside, and thereby the probability of a web break is smaller.

FIG. 4 illustrates some possible sealings, more correctly sealing profiles that can be used in the sealing space 11. The reference number 12 shows a sealing that is conventional as such, having no special labyrinth feature at all in addition to what the form of the sealing that is against the fabric 4*b* forms with the fabric 4*b*. The sealing 13 illustrates a comb-like sealing that has several, preferably more than ten partition walls. The sealing capacity of this kind of a sealing in the presented application is quite clearly better than that of the sealing 12. A more developed sealing model is shown with the reference number 14. Then each sealing brush forms its own sealing point. The sealing 15 has similar local sealing points as the sealing 14 but the sealing chambers are lower but almost circular in their form, which has a positive effect on the sealing capacity. All the sealing solutions of FIG. 4 have a bottom plate from which the sealing is attached to the sealing space 11, most suitably with screws. It is preferred to manufacture the sealing elements in such a size, that the width in the cross direction of the paper sheet is 40-150 cm, more preferably 70-90 cm. Then the manufacturing does not require big working machines and also the mounting is easier than as a long integral structure. Aluminum is one recommended manufacturing material because it can be extruded into a form profile, as well as, machined in rather varied manners into different shapes. The sealings 13-15 resemble the labyrinth sealings known per se but the sealings are able to move guided by pressurized air nearer to or further from the fabric 4*b* or in case of a malfunction under the influence of the material that has come along the web 4. With the solution according to the invention the controllability of the paper sheet 4*a* is good even at rather high web speeds.

In the solution according to FIG. 5 near the drying cylinder 1, the rotation direction of which is shown by the arrow 1*a*, there is a box-like underpressure space 16 having an upper sealing part 17 and a lower sealing part 18. The sealing element 19 is a labyrinth sealing having several sealing pockets 20*a*-20*d*, which are formed between the sealing walls. In FIG. 5 four sealing pockets 20*a*-20*d* are shown but the amount of the pockets may vary typically within the limits of 2-10. In this sealing element the pocket interspace is standard. As a sealing frame 21 there is an assembly made of a flexible material, e.g. rubber, to which assembly the sealing walls are attached from their other ends and that are replaceable with new ones at the servicing place. The upper end of the sealing frame 21 has been attached to the grooved slot 22 of the box-like part in a flexible and mobile manner. The upper part of the sealing frame below the attachment point but, however, above the topmost sealing pocket 20*d* is made of fairly thin rubber that is flexible and bends quite easily, as is shown in FIGS. 7 and 8 later on. In the lower part of the sealing frame 21 in touch therewith, there is a bellows element 23*a* or the like, the form and the front part's location of which can be changed by increasing or decreasing the pressure of the medium acting inside the bellows element. In the applications of FIG. 5 (not shown) an underpressure of a desired magnitude can be brought into different interspaces of the sealing element in order to reverse the underpressure produced at the other side, at the point in question by the opening gap of the opposite side.

In the structure according to FIG. 6 there has been used, in the sealing part 18, a labyrinth sealing, in the sealing frame 24 of which the lengths of the pockets 25*a*-25*d* in the direction of the web 4 are different. The other shapes of the sealing element are however similar to those presented in the upper sealing arrangement of FIG. 5. In the case according to FIG. 6 the overpressure in the bellows 23*b* is small or an underpressure prevails inside it. Thus, the sealing frame 24 is far from the paper web and the replacing of the sealing frames 24 is possible by endwise pushing new elements into the slot and simultaneously they push the old elements away.

In the position illustrated in FIG. 7 the sealing part 18 is in an operating position, i.e. the front parts of the sealing pockets 25*a*-25*d* are near the fabric 4*b*. The pressure of the medium has been increased in the bellows 23*b* when compared to the situation in FIG. 6. The sealing frame has been bent near the upper part due to the effect of the pressure increase in the bellows 23*b*. The advance of the front part of the bellows 23*b* is usually a few centimeters from one end of the path of movement to the other, and also the edge parts of the labyrinth pockets are almost of the same length or slightly longer. It is to be noticed that the edge parts of the labyrinth pockets are quite thin so that they would even bend when at least small so-called paper lumps hit them or at least no considerable amounts of material would loosen from them in these kinds of situations.

In a situation illustrated in FIG. 8 the labyrinth sealing is already rather worn and the path of movement of the bellows 23*b* is already at its end. A labyrinth sealing that is this worn needs already to be replaced.

The fixing structure of the sealing strips formed by the sealing gaps of the labyrinth sealing is not shown in the Figures, but it is recommended that slots with a so-called dovetail form are formed in the sealing frame 24. Correspondingly, the sealing strips have a form fitting to the dovetail, and thus the strips are pushed in their place at the servicing place.

Such applications are also advantageous in utilizing the invention, in which the above-described sealing element arrangement is part of a bigger box of the pocket space, which box maintains the sheet on the outer surface of the fabric with the aid of blow or suction arrangements or at least with a suction opening, and thus improves the runnability. When integrated to boxes presented e.g. in the patent publications FI 106568 and U.S. Pat. No. 5,782,009, the sealing arrangement according to the invention brings about considerable benefits in the entire pocket area as with the sealing arrangements a more efficient suction is achieved there, where it is needed as the amount of leaking air decreases.

The Figures illustrate only examples of preferred applications according to the invention. To a person skilled in the art, it is clear that the invention is not limited only to the above examples, but that the invention may vary within the frames of the claims presented below. In the dependent claims some possible embodiments of the invention are presented, and they are not to be considered to limit the scope of protection of the invention.

The invention claimed is:

1. A sealing arrangement against a moving fabric in a paper machine, the fabric supporting a paper sheet, which sealing arrangement comprises a stiff sealing element placed on a side of the fabric that faces away from the paper sheet, the sealing element covering the entire width of the fabric and comprising at least one labyrinth seal;

a bellows configured for moving the sealing element relative to the fabric;

wherein the sealing element is arranged on a support so that a location of the sealing element with respect to the fabric can be adjusted nearer to or further away from the fabric when the bellows expands or contracts; and wherein upon depressurization of the bellows such that the bellows contracts, the sealing element is adjusted away from the fabric by gravitational forces, and upon pressurization such that the bellows expands, the sealing element becomes adjusted nearer to the fabric by the bellows.

2. The sealing arrangement of claim 1, wherein the sealing element comprises successive cross directional sealing element units.

3. The sealing arrangement of claim 1, wherein the sealing element further comprises a frame structure, the at least one labyrinth seal being replaceably supported in a driving position near the fabric by the frame structure.

4. The sealing arrangement of claim 3, wherein the at least one labyrinth seal comprises a multi labyrinth seal.

5. The sealing arrangement of claim 1, wherein a pressure medium is used to expand or contract the bellows.

6. The sealing arrangement of claim 1, wherein the support comprises a hinge-like support element and the sealing element is supported, from its frame, on the hinge-like support element.

7. The sealing element of claim 6, wherein the hinge-like support element is located higher than the sealing element.

8. The sealing arrangement of claim 1, wherein the at least one labyrinth seal is made of aluminum board, paper board, or polymer at least regarding a part thereof that is near the fabric.

9. The sealing arrangement of claim 2, wherein a pressure medium is used to expand or contract the bellows.

10. The sealing arrangement of claim 3, wherein a pressure medium is used to expand or contract the bellows.

11. The sealing arrangement of claim 4, wherein a pressure medium is used to expand or contract the bellows.

* * * * *